United States Patent [19]

Kraus et al.

[11] 4,006,911

[45] Feb. 8, 1977

[54] RIGID SKI-MOUNTING STABILIZER

[76] Inventors: Robert A. Kraus; Edmund J. Kraus, both of 14160 Redhill, Tustin, Calif. 92680

[22] Filed: Aug. 19, 1975

[21] Appl. No.: 605,931

[52] U.S. Cl. ..... 280/11.37 E; 280/606

[51] Int. Cl.[2] ..... A63C 5/06

[58] Field of Search ..... 280/11.13 H, 11.13 T, 280/11.37 E, 11.13 R, 11.37 R, 606, 601, 611

[56] References Cited

UNITED STATES PATENTS

| | | | |
|---|---|---|---|
| 2,490,183 | 12/1949 | Wheeler | 280/11.37 E X |
| 3,751,056 | 8/1973 | Wightman | 280/11.37 E |
| 3,826,518 | 7/1974 | Hennig | 280/11.37 E X |

*Primary Examiner*—Joseph F. Peters
*Assistant Examiner*—Milton L. Smith

[57] ABSTRACT

A novel ski-mounting stabilizer for the sole purpose of holding a snow ski in a stationary position relative to the snow surface, and to provide a proper lateral alignment between the ski-binding mechanism and the ski boot, until the ski mounting operation is completed, and including a rigid receptacle which is attached to the upper side of a snow ski to receive the lower ends of a conventional ski pole, in the establishment of a rigid engagement between a ski and ski pole, for the sole purpose of holding the ski in a stationary position relative to the snow surface, and to provide a proper alignment between the ski-binding mechanism and the under side of the ski-boot until the ski mounting and step-in operation is completed. Wherein, immediately upon completion of the mounting and step-in operation, the ski-pole is removed from its receptacle, to be used in its conventional intended fashion while skiing. And wherein, further particularities provide a rigid receptacle which is constructed in such a way, that a possible accumulation of snow and ice within the receptacle can be ejected through an opening or openings at the receptacle's lower portion, as the lower end of a conventional ski pole is inserted into that receptacle's upper end.

6 Claims, 5 Drawing Figures

RIGID SKI-MOUNTING STABILIZER

BACKGROUND OF THE INVENTION

Snow skiing as performed today, should be an enjoyable and recreational experience for everyone participating in the sport. Recent years have produced great advancements in safety and ease of participation in the field of snow skiing. Safety bindings for instance, which will release or disconnect the ski from a ski boot during an unfortunate fall to prevent possible bone fracturing, are available in great varieties. Most ski safety bindings, however, require a proper alignment between ski and boot, as well as a relative absence of packsnow either on top of the skis at the area of the skis binding mechanism, or on the bottom of the ski boot, or both, before a proper connection between ski and ski boot can be accomplished. In many cases, the snow removal from the equipment and the proper alignment between ski and ski boot, in preparation for the connection of the same, demands a considerable effort even for a more experienced and conditioned skier. Consider an area at a ski resort, where the conditions are favorable for those first steps in skiing. During an unfortunate fall, however, where a ski or skis are released from their respective boot at a spot where the conditions of the snow and terrain are not suited for the troublefree preparation necessary to reconnect a ski to its corresponding boot, the efforts in reconnecting the ski to boot are amplified not only by the unsuitable conditions of the snow and terrain, but also by the lesser density of air at the altitude at which the sport of skiing is performed. In such cases of ski release, an effortless reconnection of ski to boot is almost never possible. It is therefore a sole object of our invention, to provide a stable platform for the purpose of effortless preparation and connection between ski and respective ski boot, by providing a rigid connection between ski and ski pole via a rigid receptacle constructed in such a way that the ejection of accumulative ice and snow is possible from the receptacle's bottom portion.

Operation of the Device

In operation, a conventional ski pole is inserted with its lower end into the aperture of the rigid receptacle, which is fastened to the upper side of a ski, preferably but not necessarily, in front of the ski's safety-binding, whereupon the ski-pole, if properly inserted to its utmost lower position, and the ski assume a rigid connection, longitudinal as well as lateral, respective to the ski's longitudinal center. Thereby, a convenient hand hold at any station along said pole, will stabilize the ski longitudinally into a stationary position, relative to the snow surface, as well as assuring a proper lateral alignment between the ski's safety-binding mechanism and the bottom of the ski-boot, before actual connection between ski and boot is completed, and immediately after a proper mechanical connection between ski and ski-boot is established, the ski pole within its rigid receptacle is removed, to be used in its conventional way, intended for the sport of skiing. In the event, however, that the inner aperture of the rigid receptacle has accumulated a quantity of snow and possible ice before insertion of said pole into the receptacle, the lower end of the pole is used to eject said accumulation of snow and ice within the receptacle through the opening or openings in the receptacle's lower portion. By pushing the snow and ice formation downward and out, the pole can assume a rigid engagement with the crests of the receptacle's longitudinal inner ridges to allow the pole to reach its proper most lower position within the receptacle.

DESCRIPTION OF THE PREFERRED EMBODIMENT

Figure 4:
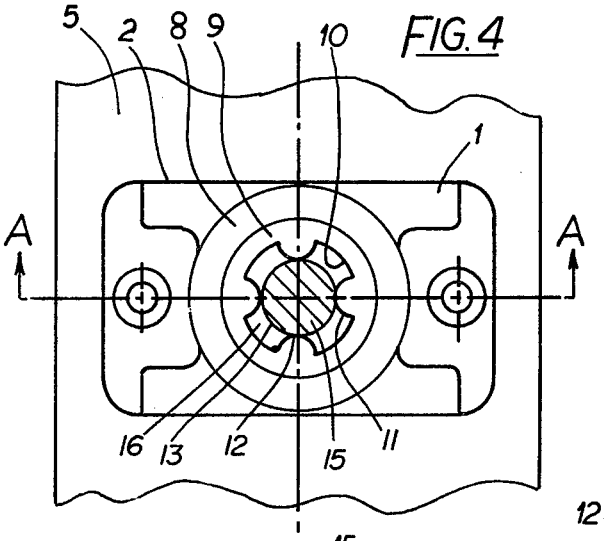
FIG. 4 shows the device as viewed from the top.
Figure 3:
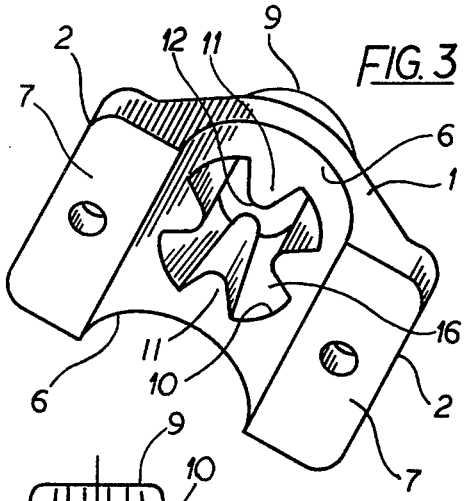
FIG. 3 is a perspective bottom view of the device, showing the openings of the receptacle's lower portion and the longitudinal internal ridges, which make contact with the pole when inserted.
Figure 2:
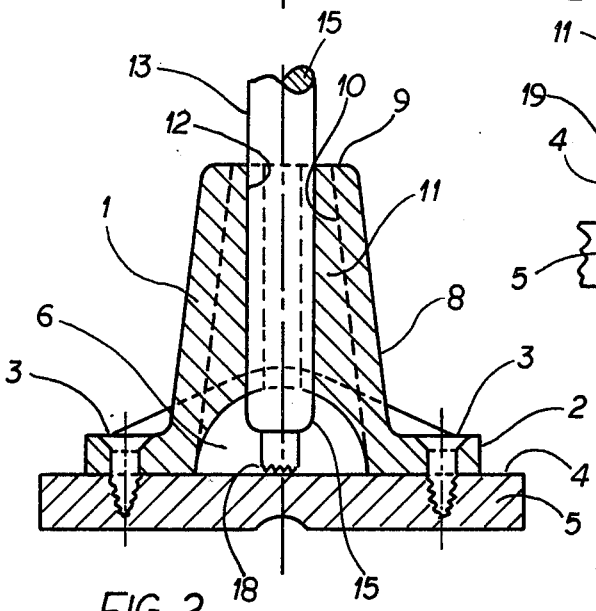
FIG. 2 is a sectional view of the stabilizer receptacle through section A—A of FIG. 4, showing a rigid engagement between the lower portion of a conventional ski pole and the crests of the receptacle's internal ridges, mounted to a section of ski.

As illustrated in the drawings, FIGS. 1, 2, 3 and 4, the device of this invention includes a main body 1 having two opposing flange portions 2, for the purpose of fastening the device herein via wood screws 3 to the upper side 4 of the snow ski 5, as well as having two opposing openings 6 on the receptacle's lower portion 7, for the purpose of ejecting a possible accumulation of ice and snow. Basically, the main body 1 consists of a substantially conical outer wall 8, extending from the two lower opposing flanges 2, upward to the upper ends 9, while the inner wall 10 of the vertically mounted receptacle conforms angular substantially to the outer wall 8, to establish a substantially equal wall thickness of the main body 1. The receptacle's inner wall 10 incorporates a series of longitudinal ridges 11, having crests 12 running longitudinal from the device's lower openings 6 to the device's upper ends 9. The longitudinal crests 12 of the ridges 11 are spaced substantially parallel to each other in such a way as to tightly grip the outer wall 13 of the inserted lower pole end 15, to establish a rigid mechanical connection between ski pole 15 and ski 5.

Inherent in the design of the device, the hollow spaces 16 between the inner wall 10, ridges 11, and the outer wall 13 of the inserted ski pole 15, increase steadily downward in their sections from the upper ends 9 to the lower openings 6, to provide tapered downwardly increasing spaces 16, to assure an easy removal of possible ice and snow from within the receptacle, as the lower end of ski pole 15 is inserted into the receptacle's longitudinal aperture 17, and to assure a proper insertion of the lower pole end 15 to its utmost lower position 18.

Alternate Embodiment of the Device

Figure 5:
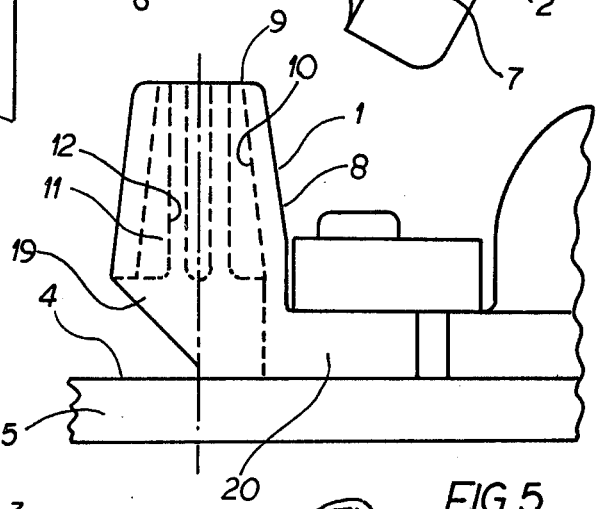
FIG. 5 is an illustration of an alternate embodiment, showing the receptacle in combination with a part of a safety-binding as a homogeneous unit. The part of the safety-binding comprising the stabilizer receptacle could either represent the front, or rear portion of the safety-binding, depending on the safety-binding's particular mechanical design.
Figure 1:
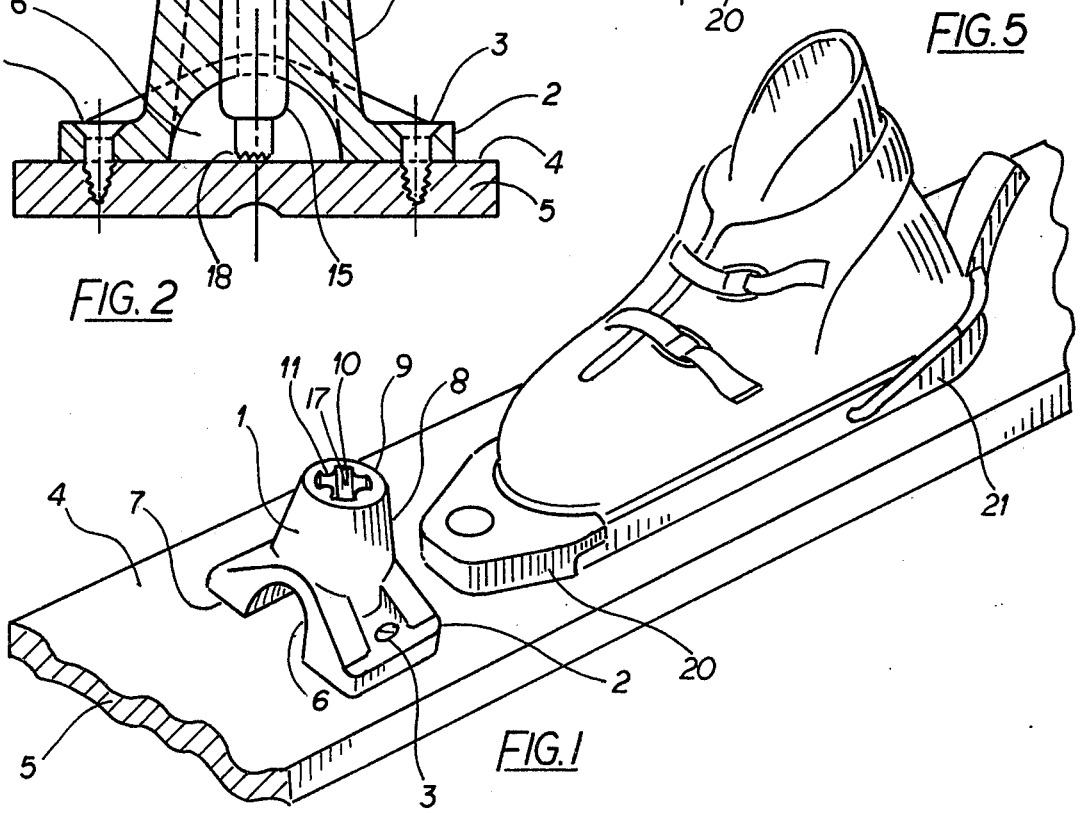
FIG. 1 is a perspective view of a ski-boot, mounted via ski safety-binding to the broken center section of a snow ski, showing the preferred, but not necessary location of the stabilizer receptacle in accordance with the present invention, installed on top of the section of snow ski.

FIG. 5 shows an alternate embodiment of the device, which is constructed to conform in its basic internal configuration and design with the preferred embodiment in detail except for the use of only one or more openings 19 for the snow and ice removal, and for its incorporation into the total design of either the front part 20, or the rear part of a ski safety-binding 21, to form a homogeneous singular unit, with either the front or rear portion of the actual safety-binding 21, and wherein, only the external design changes to effect a good esthetical appearance and to suit the mechanical design and configuration of the ski safety-binding itself.

The foregoing detailed descriptions are to be clearly understood as given by way of illustration and example only, the spirit and scope of this invention being limited solely by the appended claims.

We claim:

1. A device for the rigid reception of a conventional ski pole to stabilize and align a snow ski during the mounting operation to its corresponding ski boot, comprising a substantially conical receptacle having at least one flange on its lower portion for the purpose of fastening the receptacle to the upper side of a snow ski, and having at least one opening on its lower portion for the purpose of ejecting a possible accumulation of ice and snow from within by pushing the lower end of a ski pole into the receptacle's axial aperture, and comprising a series of longitudinal internal ridges extending from the receptacle's substantially conical inner wall inwardly in such a way as to align the receptacle's longitudinal inner ridge's crests substantially parallel to each other, so that if the lower end of a conventional ski pole is inserted into the receptacle's axial aperture each of the longitudinal ridge's crests will make a full longitudinal contact with the outer wall of the inserted ski pole to establish a rigid mechanical connection between the ski and the ski pole, and wherein the receptacle's inner spaces increase from the receptacle's upper end downward to the receptacle's lower opening.

2. A device as in claim 1, wherein the upper end of the vertical receptacle is tapered substantially downwardly and inwardly, to allow an easy insertion of the lower end of a ski pole into that receptacle's vertical aperture.

3. A device as in claim 1, wherein the opening for the ejection of possible accumulated ice and snow from within the receptacle points downward and out with a substantial angular direction from the receptacle's center line.

4. A device as in claim 1, in combination with a conventional ski safety release binding, wherein the device and the ski safety release binding constitute a singular homogeneous unit, and wherein the purpose is two fold; first to align the ski and ski boot with each other during ski and ski boot connecting operation and second, to securely keep a snow ski and ski boot connected for the participation in the sport of snow skiing.

5. A device as in claim 1 constructed in one piece to make a rigid connection between a snow ski and ski pole, when the lower end of a conventional ski pole is inserted into the vertical aperture of that device.

6. A device as in claim 1, the device being incorporated into the mechanical ski safety release mechanism, to form a singular unit with said ski safety release mechanism.

* * * * *